United States Patent [19]

Dicker

[11] 4,157,759

[45] Jun. 12, 1979

[54] CONTINUOUS MAILER

[75] Inventor: David Dicker, Scarsdale, N.Y.

[73] Assignee: Transkrit Corporation, Elmsford, N.Y.

[21] Appl. No.: 926,625

[22] Filed: Jul. 21, 1978

[51] Int. Cl.[2] ..... B65D 27/34

[52] U.S. Cl. ..... 206/610; 206/632; 229/69; 229/73

[58] Field of Search ..... 229/69, 73; 206/610, 206/611, 632, 629

[56] References Cited

U.S. PATENT DOCUMENTS

| | | | |
|---|---|---|---|
| 3,111,257 | 11/1963 | Peach | 229/73 |
| 3,419,286 | 12/1968 | Noonan et al. | 229/69 X |
| 3,552,641 | 1/1971 | Bell et al. | 229/69 |
| 3,941,307 | 3/1976 | Van Malderghem | 229/69 |
| 3,955,751 | 5/1976 | Mayne | 229/73 |

FOREIGN PATENT DOCUMENTS

| | | | |
|---|---|---|---|
| 469192 | 7/1914 | France | 206/610 |

*Primary Examiner*—Stephen P. Garbe
*Attorney, Agent, or Firm*—Kenyon & Kenyon

[57] ABSTRACT

The continuous mailer is provided with a removable tab portion along the top or bottom edge of the back ply. The tab portion has a free flap at one end which can be lifted so that the tab portion can be easily grasped and stripped from the mailer. Removal of the tab portion not only exposes a return mail envelope within the pocket of the continuous mailer but also effects removal of a tab portion on a rear ply of the return mail envelope. The tab portion on the front ply of the return mail envelope can be folded over to seal the pocket of the return mail envelope.

15 Claims, 7 Drawing Figures

Fig. 1.
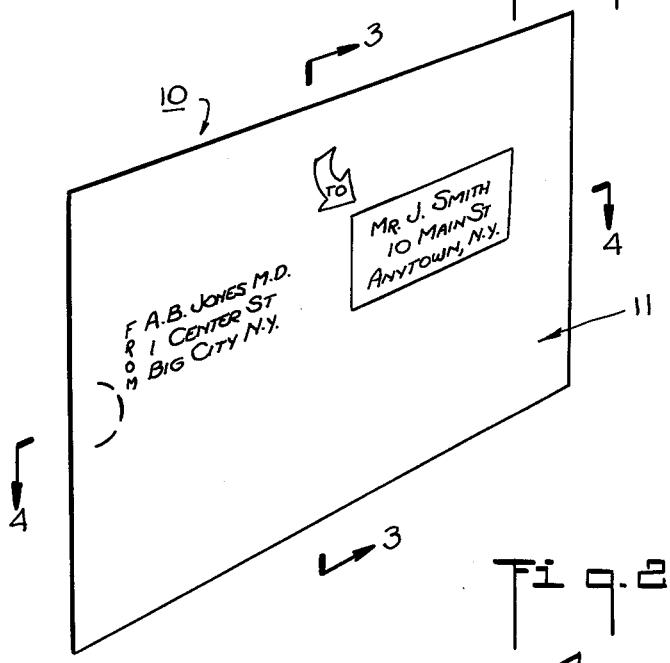
Fig. 2.
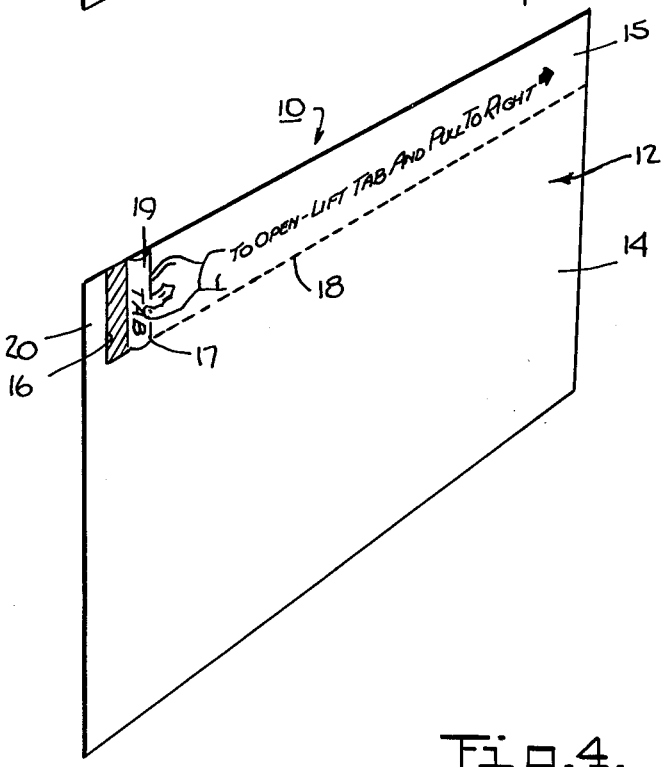
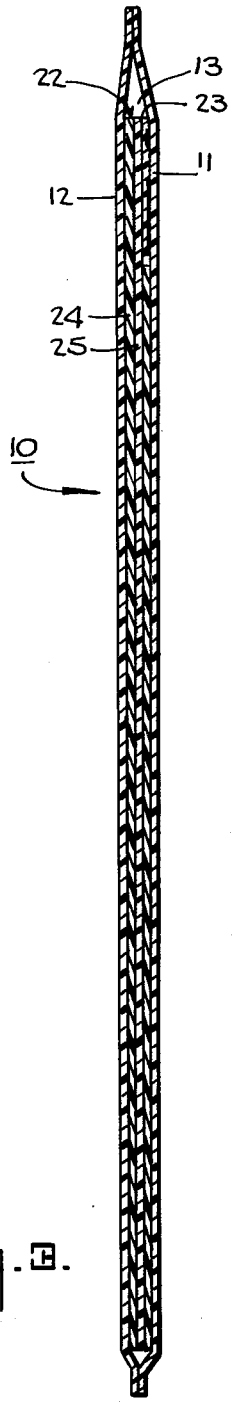
Fig. 3.
Fig. 4.
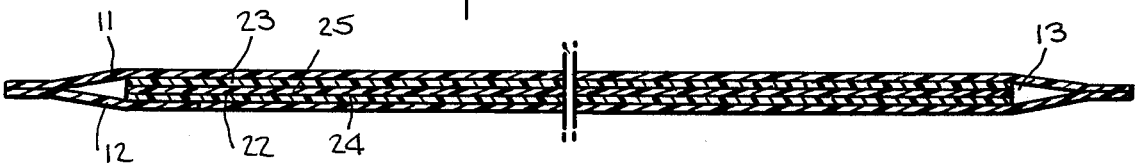

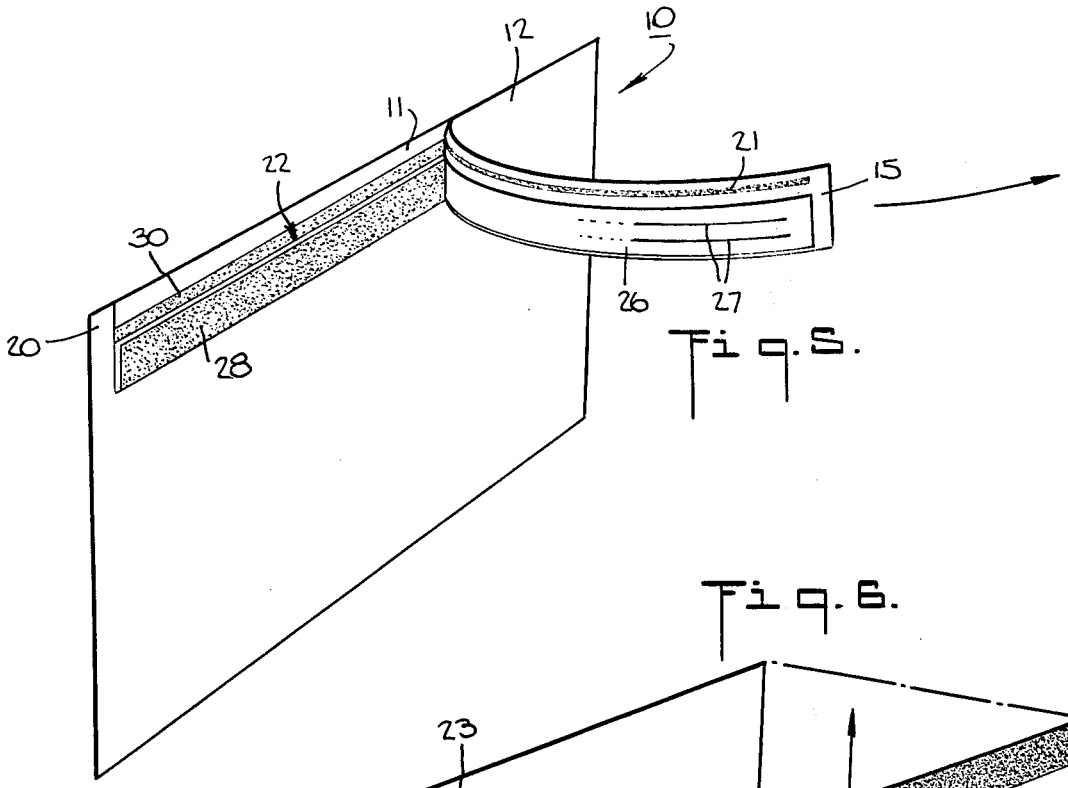
Fig. 5.
Fig. 6.
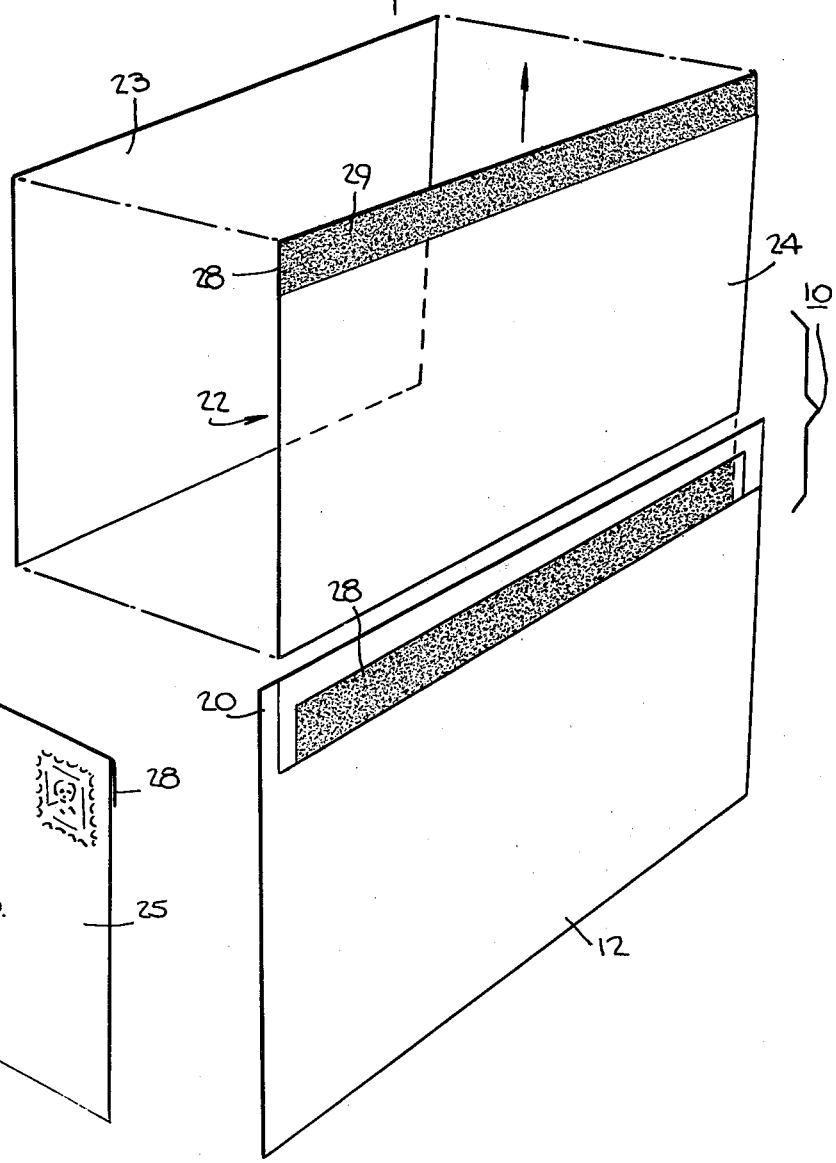
Fig. 7.
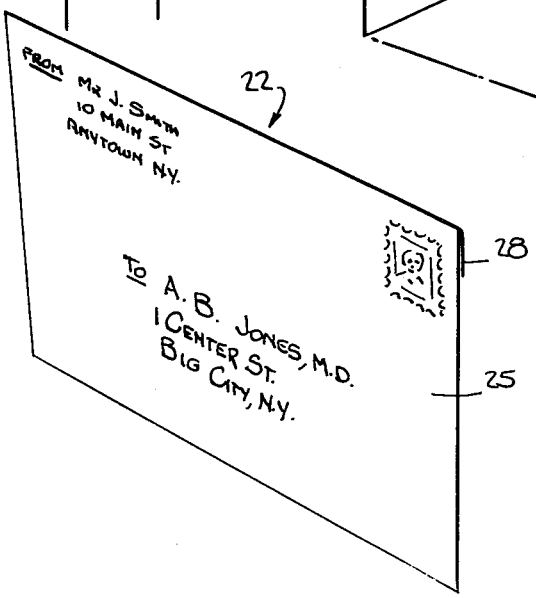

CONTINUOUS MAILER

This invention relates to a continuous mailer. More particularly, this invention relates to a continuous mailer which incorporates a return mail envelope therein.

As is known, various types of continuous mailers have been constructed and used for mailing inserts and return envelopes which can be returned to a sender. In some cases, the continuous mailers have been constructed as a snap set so that a side of the continuous mailer can be removed to expose the contents. Usually, the contents include one or more inserts and a return mail envelope in which the inserts can be returned to an original sender. However, these snap set constructions have not always been easy to open and, in some case, opening of the mailers has damaged portions of the inserts. In addition, the return mail envelopes usually require stripping of a tab portion from one ply in order to provide a sealing flap on an opposed ply. This, of course, requires an additional effort on the part of the user if a return message is to be sent.

Accordingly, it is an object of the invention to provide a continuous mailer which can be easily opened.

It is another object of the invention to provide a continuous mailer with a tab portion which can be easily removed in order to open the mailer.

It is another object of the invention to provide a continuous mailer with a return mail envelope which is opened and ready for sealing upon opening of the mailer.

It is another object of the invention to provide a continuous mailer with a tab portion which can be fabricated in a relatively easy and economical manner.

Briefly, the invention provides a continuous mailer which is comprised of two plies which are secured together to define an enclosed pocket and one or more inserts including a return mail envelope in the enclosed pocket. One ply, which serves as a back ply, is provided with a removable tab portion which is releaseably secured to the front ply in order to provide for access to the contents of the pocket.

The return mail envelope includes a ply which has a removable tab portion fixedly secured to the tab portion of the back ply of the mailer for removal therewith. The return mail envelope also has a second ply secured to the first ply to define a second pocket. This second ply also has a tab portion which faces the tab portion of the first ply for folding over onto the first ply after removal of the tab portion on the first ply in order to close the pocket of the return mail envelope. This tab also carries a suitable means for sealing against the first ply.

When the continuous mailer is to be opened, the tab portion on the back ply is stripped off to expose the contents of the mailer. At the same time, the tab portion of the return mail envelope which is secured to the tab portion of the mailer is also stripped away. As a result, the return mail envelope is in an opened condition to receive a suitable insert. Once an insert has been placed in the return mail envelope, the remaining tab portion can be folded over to seal the envelope.

The back ply of the continuous mailer is also provided with a slit to define an end edge of the removable tab portion and a line of perforations which extends along the tab portion to define a side edge thereof. In order to facilitate removal of the tab portion, the slit may be L-shaped to define a free flap in the tab portion at the end. This flap is sized to be folded away from the mailer a sufficient distance to permit grasping of the flap and subsequent stripping of the tab portion from the mailer.

The front ply of the continuous mailer is provided with a coating of an image transfer medium on a side facing the return mail envelope so that information can be imparted to both the mailer and return mail envelope simultaneously as well as to any insert within the mailer in known fashion.

These and other objects and advantages of the invention will become more apparent from the following detailed description taken in conjunction with the accompanying drawings wherein:

FIG. 1 illustrates a view of a front face of a continuous mailer according to the invention;

FIG. 2 illustrates a rear view of the continuous mailer of FIG. 1;

FIG. 3 illustrates a view taken on line 3—3 of FIG. 1;

FIG. 4 illustrates a view taken on line 4—4 of FIG. 1;

FIG. 5 illustrates a rear view of a continuous mailer during removal of the tab portions of the mailer and return mail envelope in accordance with the invention;

FIG. 6 illustrates an exploded view of a continuous mailer; and

FIG. 7 illustrates a front view of a return mail envelope incorporated within a continuous mailer according to the invention.

Referring to FIGS. 1 and 2, the continuous mailer 20 is of conventional size and shape, for example of rectangular shape. The mailer 10 includes a front ply 11 for receiving printed information and a back ply 12 which is secured to the front ply 11 in any suitable manner, for example by means of glue lines, in order to define an enclosed pocket 13 (FIG. 3).

Referring to FIG. 2, the back ply 12 includes a main portion 14 and a removable tab portion 15. The tab portion 15 extends widthwise across the back ply 12 from one edge (the right-hand edge as shown) of the back ply 12 to a point short of the opposite edge. The back ply 12 also has a L-shaped slit 16 to define an end edge 17 of the removable tab portion 15 as well as a line of perforations 18 which extends along the tab portion 15 to define a side edge of the tab portion 15 and to separate the tab portion 15 from the main portion 14. As shown, the end of the tab portion 15 is not secured to the front ply 11 so that a free flap 19 is defined by the L-shaped slit 16 in the tab portion 15. In addition, slit 16 defines a tail 20 of the main portion 14 which separates the flap 19 from the left-hand edge of the ply 12, as viewed.

As shown in FIG. 5, the tab portion 15 is releasably secured to the front ply 11 by a line of suitable adhesive 21 or dots of adhesive or other suitable means.

Referring to FIGS. 3 and 4, the continuous mailer 10 also has a return mail envelope 22 and an insert 23 disposed within the enclosed pocket 13 between the front and back plies 11, 12. The return mail envelope 22 is formed of two plies 24, 25 which are of the same size and shape. The ply 24 which faces the back ply 12 has a tab portion 26 which underlies and is fixedly secured to the tab portion 15 of the back ply 12, for example, by means of one or two lines 27 or dots of adhesive (see FIG. 5). This tab portion 26 is separated from the remainder of the ply 24 by a suitable line of perforations (not shown). The other ply 25 of the envelope 22 is secured about three sides to the ply 24 to define an open pocket therewith. In addition, this ply 25 has a tab portion 28 which faces and overlies the removable tab portion of the ply 24. As shown in FIG. 6, this tab portion 28 is sized for folding over the ply 24 after removal of the tab portion 26 and carries an adhesive means 29 such as a water-activated adhesive for sealing the folded over tab portion 28 against the ply 24 (FIG. 7).

The tab portion 28 may be separated from the remainder of the ply 25 by a line of scoring or a line of perforations (not shown) in order to facilitate folding over the other ply 24.

As shown in FIG. 3, the insert 23 is disposed behind the return mail envelope 22 relative to the back ply 12 of the mailer 10.

As shown in FIG. 6, the plies of the continuous mailer 10 are of rectangular shape. Also, the plies of the return mail envelope 22 are of less width and less length than the front and back plies 12, 11 of the mailer 10.

Referring to FIG. 5, the front ply 11 may also be provided with a coating 30 of an image transfer medium on the side facing the insert 23, in known manner, so as to permit the transfer of printed information onto the insert. There may also be a coating of an image transfer medium on the back of the insert 23 facing the return envelope 22 so as to permit the transfer of printed information.

In order to make the continuous mailer 10, a number of sheets from which the plies and inserts are made are processed in a rotary printing press and collated on a collator. Generally, the various sheets are provided in rolls and are collated upon being drawn from the rolls. Further, in order to permit threading and aligning in the collator, the left and right edges of the sheets which are to form the plies 12, 11 of the mailer are marginally hole punched while only one edge of the sheets to form the inserts i.e., the return mail envelope 22 and insert 23, is marginally hole punched. During threading, the various sheets are glued and the inserts are chipped out and die cut on the collator just before gluing together. Generally, fugitive glue is used to hold the various plies together.

For example, rolls of blank paper are fed into the rotary printing press which will print both sides of a web of paper, number, spot carbonize, perforate vertically and horizontally, punch marginal holes and file holes. The web is rewound into a roll at the end of the press. The rolls of printed paper comprising one of each of the parts of the mailer are mounted onto spindles on the collating machine. The collating machine will gather the rolls together to form a continuous mailer, using the marginally punched line holes on the printed rolls to register each ply of the mailer. The collator will cut inserts of the mailer to a smaller size by means of cutting knives and cutting wheels, glue all the necessary parts and then perforate the upper and lower edge of the mailer so that the mailer can be folded into packs suitable for use, for example by a computer printer at a customer's location. The computer printer can then print all the information required onto the mailer using the marginally punched holes as a means of feeding the continuous mailers into the computer printer.

Upon issuance from the computer printer, the perforated edges are stripped from the sheets so that the resultant mailers are as shown in FIG. 1. Typing is done before perforated edges are stripped off.

After mailing to a recipient, the recipient will fold back the flap 19 on the tab portion and then strip the tab portions 15 from the back ply 12. Because of the securement of the tab portion 26 on the return mail envelope 22 to the tab portion 15, this tab portion 26 is also stripped away and the return mail envelope 22 is presented in an opened condition to the recipient. The recipient can then remove the envelope 22 and insert 23 from the mailer and, thereafter, may fold the insert and/or payment and place the same in the envelope 22 for return mailing to the sender. At this time, the tab portion 28 would be moistened and then folded over and sealed against the rear ply 24 of the envelope 22 (FIG. 7).

It is to be noted that any number of inserts may be placed within the continuous mailer so that a recipient may retain a duplicate copy of the material which is returned in the envelope 22.

It is to be noted that the free flap 19 may be formed in other manners. For example, the free flap 19 may be defined by the vertical slit 16 and a hole (not shown) which is punched in the back ply 12 in alignment with the slit 16.

What is claimed is:

1. A continuous mailer comprising a front ply for receiving printed information thereon;

a back ply secured to said front ply to define an enclosed pocket therewith, said back ply having a main portion, a tab portion adjacent said main portion, a line of perforations extending across said main portion to separate said tab portion from said main portion, and an L-shaped slit between one end of said tab portion and said main portion to define a free flap at said end of said tab portion; and a return mail envelope disposed in said pocket between said front and back plies, said return mail envelope including a first ply having a removable tab portion underlying and secured to said tab portion of said back ply for removal therewith, said second ply secured to said first ply to define a second pocket, said second ply having a tab portion underlying said tab portion of said first ply for folding over onto said first ply after removal of said tab portion of said first ply, and adhesive means on said tab portion of said second ply for sealing against said first ply.

2. A continuous mailer as set forth in claim 1 which further comprises an insert in said enclosed pocket between said front and back plies.

3. A continuous mailer as set forth in claim 1 wherein said first and second plies of said return mail envelope are of less width and less length than said front and back plies.

4. A continuous mailer as set forth in claim 1 wherein said first ply of said return mail envelope has a line of perforations separating said tab portion thereof from the remainder of said first ply.

5. A continuous mailer as set forth in claim 1 wherein said plies are of rectangular shape and said tab portion of said back ply extends widthwise across said back ply.

6. A continuous mailer as set forth in claim 5 which further comprises a first glue line releasably securing said tab portion of said back ply to said front ply and a pair of glue lines fixedly securing said tab portion of said first ply to said tab portion of said back ply.

7. A continuous mailer as set forth in claim 1 wherein said front ply has a coating of an image transfer medium on a side facing at least one of said return mail envelope and insert.

8. A continuous mailer as set forth in claim 1 wherein said flap is sized to be folded away from said front ply to provide for manual grasping thereof for removal of said tab portion of said back ply.

9. A continuous mailer comprising a front ply;

a back ply secured to said front ply to define an enclosed pocket therewith, said back ply having a removable tab portion releaseably secured to said front ply, a slit to define an end edge of said removable tab portion and a line of perforations extending along said tab portion to define a side edge of said removable tab portion; and at least a return mail envelope disposed in said enclosed pocket between said plies, said return mail envelope including a first ply having a removable tab portion underlying and secured to said tab portion of said back ply for removal therewith.

10. A continuous mailer as set forth in claim 9 wherein said slit is L-shaped to define a free flap in said tab portion at said end.

11. A continuous mailer as set forth in claim 9 wherein said return mail envelope includes a second ply secured to said first ply to define a second pocket, said second ply having a tab portion underlying said tab portion of said first ply for folding over onto said first ply after removal of said tab portion of said first ply, and adhesive means on said tab portion of said second ply for sealing against said first ply.

12. A continuous mailer as set forth in claim 9 which further includes at least one insert in said enclosed pocket.

13. A continuous mailer as set forth in claim 12 wherein said insert is sized to fit into said return mailer.

14. A continuous mailer as set forth in claim 9 wherein said plies are of rectangular shape and said tab portion of said back ply extends widthwise across said back ply.

15. A continuous mailer comprising a front ply having an image transfer coating on one side;

a back ply peripherally secured to said front ply in facing relation to said coating to define an enclosed pocket, said back ply having a removable tab portion releaseably secured to said front ply; and a return mail envelope disposed in said pocket between said front and back plies, said return mail envelope including a first ply having a removable tab portion secured to said tab portion of said back ply for removal therewith, a second ply secured to said first ply to define a second pocket, said second ply having a tab portion facing said tab portion of said first ply for folding over onto said first ply after removal of said tab portion of said first ply to close said second pocket, and means on said tab portion of said second ply for sealing against said first ply.

* * * * *

UNITED STATES PATENT AND TRADEMARK OFFICE

CERTIFICATE OF CORRECTION

PATENT NO. : 4,157,759

DATED : June 12, 1979

INVENTOR(S) : David Dicker

It is certified that error appears in the above-identified patent and that said Letters Patent are hereby corrected as shown below:

Column 2, line 28, change "20" to --10--

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,157,759

DATED : June 12, 1979

INVENTOR(S) : DAVID DICKER

It is certified that error appears in the above–identified patent and that said Letters Patent are hereby corrected as shown below:

Column 4, line 36, change "said" (second occurrence) to

--a--

Signed and Sealed this

*Thirteenth* Day of *March 1984*

[SEAL]

*Attest:*

GERALD J. MOSSINGHOFF

*Attesting Officer*

*Commissioner of Patents and Trademarks*